US005873798A

United States Patent [19]

Bostick

[11] Patent Number: 5,873,798

[45] Date of Patent: Feb. 23, 1999

[54] SOCCER SPEED AGILITY AND CONDITIONING TRAINING APPARATUS

[76] Inventor: Blake M. Bostick, 2809 NW. Expressway, #460, Oklahoma City, Okla. 73112

[21] Appl. No.: 847,353

[22] Filed: Apr. 24, 1997

[51] Int. Cl.[6] ..... A63B 69/00

[52] U.S. Cl. ..... 473/426

[58] Field of Search ..... 473/426, 423, 473/212, 213

[56] References Cited

U.S. PATENT DOCUMENTS

| | | | |
|---|---|---|---|
| 708,573 | 9/1902 | Miles | 473/426 X |
| 861,506 | 7/1907 | Doyle | 473/426 |
| 2,496,795 | 2/1950 | Johnson . | |
| 3,271,030 | 9/1966 | Mueller | 473/423 |
| 4,241,914 | 12/1980 | Bushnell . | |
| 4,278,257 | 7/1981 | Garcia . | |
| 4,460,172 | 7/1984 | Hogan | 473/426 |
| 4,576,379 | 3/1986 | Juhasz . | |
| 4,944,513 | 7/1990 | Zentner . | |
| 4,966,367 | 10/1990 | Oyarzabal . | |
| 5,083,797 | 1/1992 | Vartija . | |
| 5,098,094 | 3/1992 | Kita . | |
| 5,280,922 | 1/1994 | Jones . | |
| 5,419,550 | 5/1995 | Blom . | |
| 5,553,848 | 9/1996 | Amron . | |

*Primary Examiner*—William H. Grieb

[57] ABSTRACT

There is provided a training apparatus that has either portable or permanently fixed upright poles whereby a ball is suspended between the upright poles by a plurality of springy tethers that are moveably connected between the upright poles with means provided to raise or lower the springy tethers and suspended ball to different heights along the lengths of the upright poles. Tether anchoring means are provided on each upright pole so that tension to the springy tether may be adjusted and thereby increase or decrease the return speed of the ball when kicked, according to the users desire. The ball may be struck from either side of the device.

17 Claims, 2 Drawing Sheets

SOCCER SPEED AGILITY AND CONDITIONING TRAINING APPARATUS

FIELD OF THE INVENTION

This invention relates to athletic training equiptment for speed of the feet, agility of the feet and body, coordination, and physical stamina or conditioning.

BACKGROUND—DESCRIPTION OF PRIOR ART

In the sport of soccer speed of the feet, agility of the feet and body, eye to foot coordination, and physical stamina or conditioning are in the top priority of the necessities a soccer player needs or should train at acquiring. Part of the basic "skills training" players are taught are the training regimens of dribbling the ball back and forth between the feet, juggling the ball with the feet, knees, chest, and head, and negotiating the ball around or through colored cones placed on the ground. During these regimens control of the ball is frequently lost and the ball must be chased down to resume practice.

The closest prior art to the present invention contemplates the user placing one foot on a platform while, with the other foot, kicking a ball tethered with elastic bands at a constant low height. This apparatus also contemplates that one foot of the player must at all times remain in contact with the platform of the apparatus so as to provide stabilization. The present invention has advantage over this prior art because the present invention allows the user to make natural movements of the body, as relates to the bodily movements necessary to kick a soccer ball. The present invention also allows the user to use both feet in alternating succession. Thus, training is provided by the present invention to help an individual to refine the movements that are necessary and actually occur during performance of the sport. This is because the ball on the present invention is allowed to travel vertically as well as horizontally and can be adjusted to different heights.

Several other related examples of prior art show training practice devices whereby a ball is attached to a tether line or anchor in the form of a helical coil. These devices must be staked to the ground and the ball is then kicked and then retrieved by rewinding the line or by the retraction of the coil. These devices must be used out of doors. The present invention may be used either in or out of doors and, depending on the variation, may be either permanently mounted or portable. The present invention also requires no effort by the user for the ball to be returned to its original position.

OBJECTS AND ADVANTAGES

The sport of soccer requires speed of the feet, agility of the feet and body, eye to foot coordination, and physical stamina or conditioning. Players train at acquiring these traits by dribbling the ball back and forth between the feet, negotiating the ball around cones placed on the ground, and juggling the ball with the feet, knees, chest, and head. During these exercises control of the ball is frequently lost and must be retreived. It is therefore an object of this invention to provide an athletic training device for the sport of soccer for speed of the feet, agility of the feet and body, physical coordination, and physical stamina or conditioning.

It is another object to greatly improve on any other similar training devices in the field.

It is another object to provide such a training device that can be used either indoors or out and either on turf or hard floor by allowing the device to be permanently mounted, staked to the ground, or merely to rest on the ground by its own weight.

It is another object to provide such a device for training by an individual which is easy to use and does not require substantial set up time.

It is another object to provide such a training device that can easily be adjusted for height and speed of ball return to suit the particular needs and abilities of individual players.

It is another object to provide such a training device that will not allow the ball to escape control of the player. This negates wasted time spent by the player chasing the ball and allows the player to focus on the training itself.

It is another object to provide such a training device that will provide benefits of emulating, enhancing, or refining the bodily movements that will actually occur during performance of the sport of soccer.

It is another object to provide such a training device that by its use will provide to the trainee an increased ability to perform sports requiring eye to foot coordination.

It is another object to provide such a training device that can, by its physical properties, provide a customized training session to the user with only minimal adjustment.

It is another object to provide such a training device that can be constructed of any material suitable to withstand vibration, wear and tear, and provide suitable tensile strength.

Further objects and advantages of my invention will become apparant from a consideration of the drawings and ensuing description.

Figure 1:
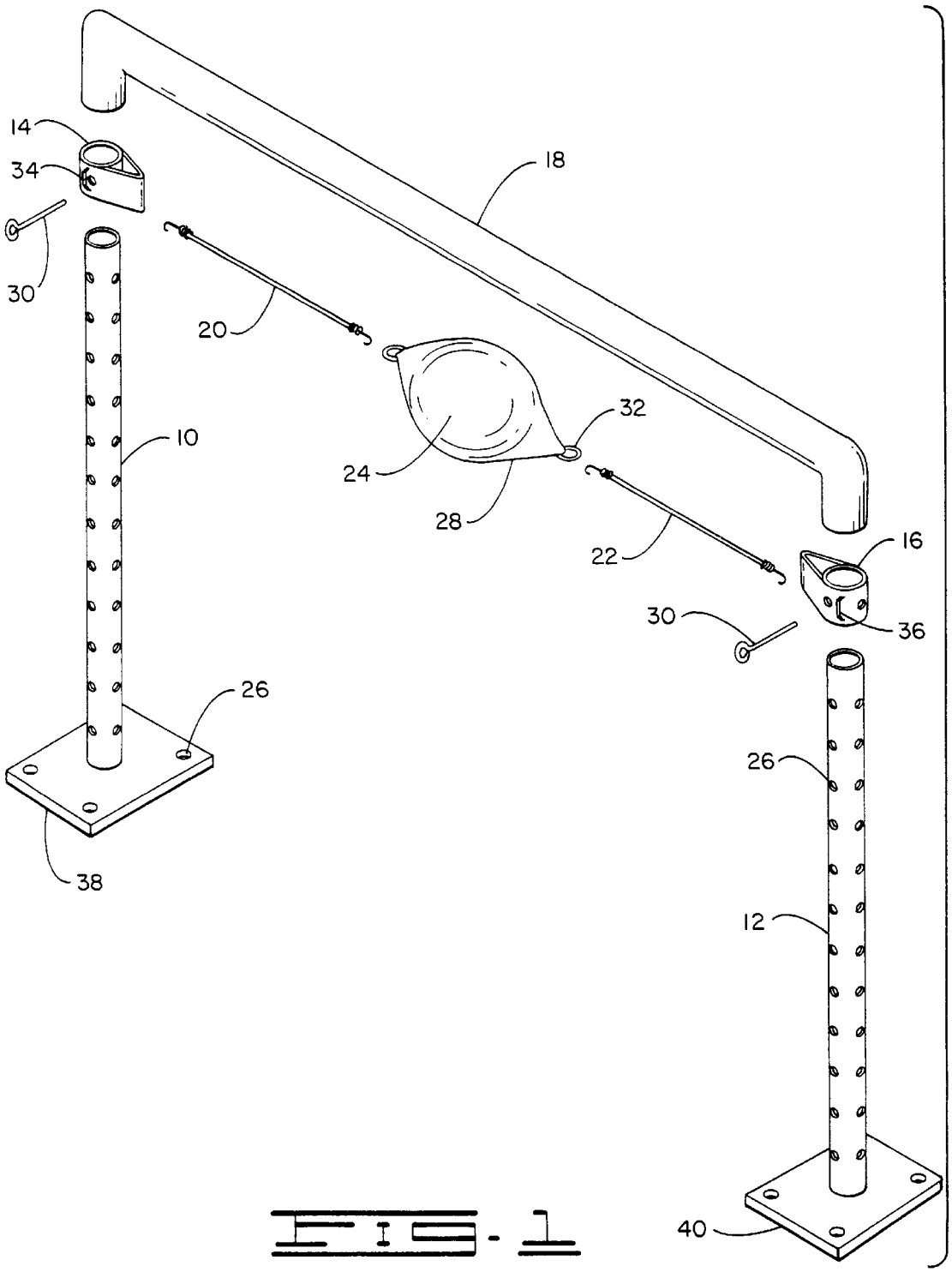
FIG. 1 is a perspective view showing the apparatus of the subject invention.
Figure 2:
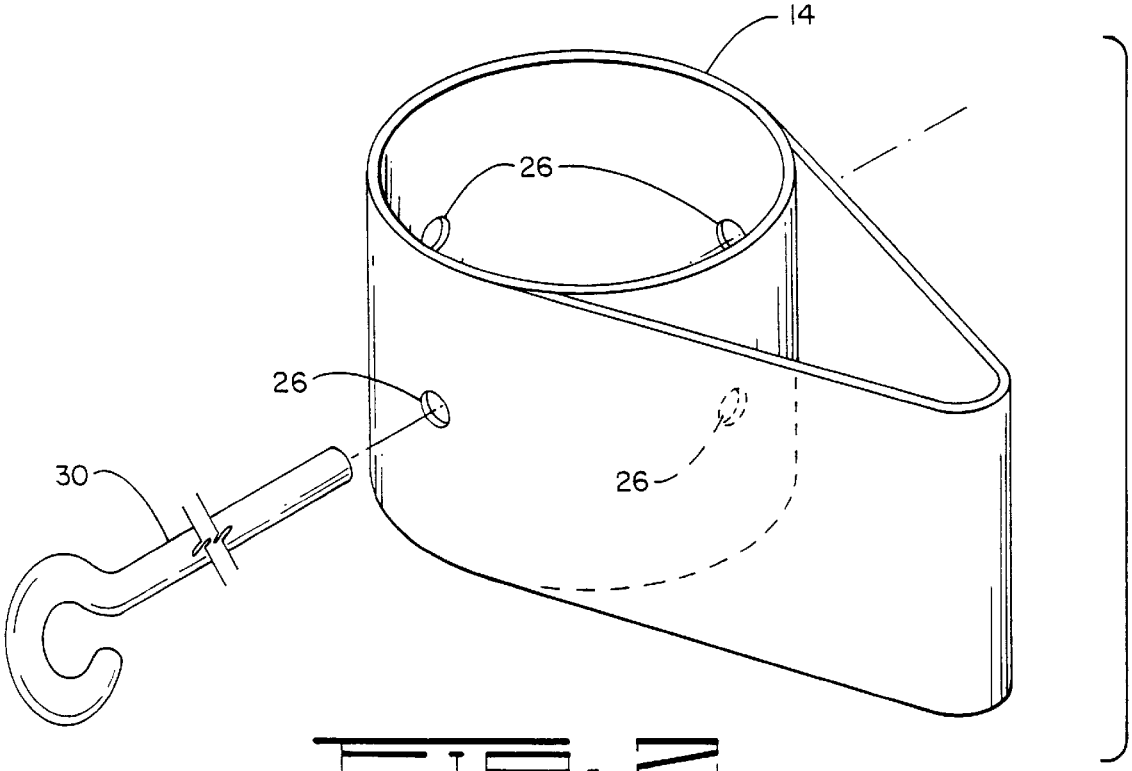
FIG. 2 is a perspective of the left rotable cam lever sleeve which is identical to the right rotable cam lever sleeve.
Figure 3:
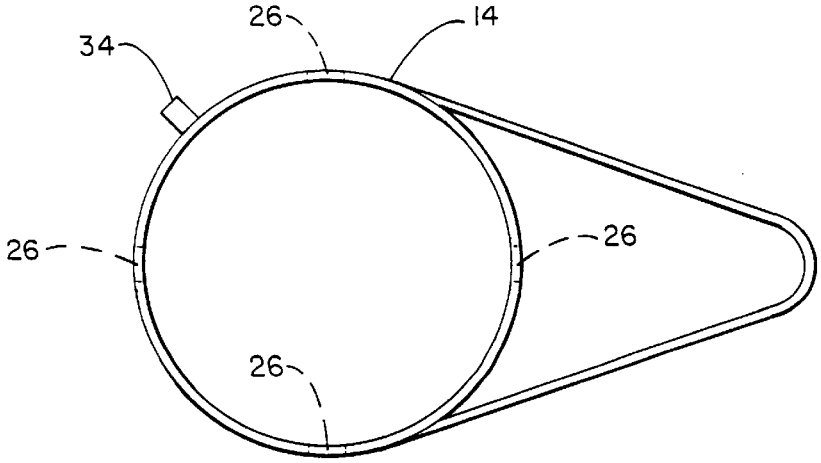
FIG. 3 is a top elevational view of the left rotable cam lever sleeve which is identical to the right rotable cam lever sleeve.

| REFERENCE NUMERALS IN DRAWINGS | |
|---|---|
| 10 left upright pole | 12 right upright pole |
| 14 left rotable cam lever sleeve | 16 right rotable cam lever sleeve |
| 18 top stationary bar | 20 left springy tether |
| 22 right springy tether | 24 soccer ball |
| 26 hole | 28 bag for ball |
| 30 key | 32 eyelet of bag for ball |
| 34 eyelet of left rotable sleeve | 36 eyelet of right rotable sleeve |
| 38 left base | 40 right base |

SUMMARY OF THE INVENTION

The invention contemplates providing either portable or permanently fixed upright stands whereby a soccer ball is suspended between the upright stands by means of springy tethers. Springy tether anchoring means are provided on each upright stand so that tension can be adjusted to the springy tethers and thereby increase or decrease the return speed of the ball when kicked, according to the users desire.

The height of the springy tethers and suspended ball may also be conveniently raised or lowered to provide different heights of the ball to simulate actual game conditions or allow different manners of practice and training. A significant feature of the invention is that the ball may be struck from either side of the invention and may be conveniently adjusted to the individuals level of speed and agility or desired training aspect. The invention may be constructed of any material suitable to withstand vibration, wear and tear, and provide sufficient tensile strength.

DESCRIPTION OF THE PREFERRED EMBODIMENTS

In FIG. 1 there is provided a soccer training device.

1. The device may be secured to the ground by;

a. setting the upright poles 10 and 12 in concrete; or, b. by anchor devices driven into the ground through holes 26 in the base plate 38 and 40; or, c. by applying pressure with the foot to the base plate 38 and 40 whereby a spike on the underside of the base plate 38 and 40 is driven into the ground; or, d. the base plates 38 and 40 rest on the ground.

2. The device may be secured to a hard floor by;

a. anchor devices extending through holes in the base plates 38 and 40 into the floor to be set in concrete; or, b. the base plates 38 and 40 rest on the floor; or, c. the upright poles 10 and 12 are set into the floor at predetermined space from each other.

3. The upright poles 10 and 12 extend up from ground or floor level.

4. The upright poles 10 and 12 are of predetermined length. In one variation, an eylet 34 and 36 may be fixed to a rotable sleeve 14 and 16 with a cam type lever attached.

Such a rotable cam lever sleeve 14 and 16 is provided for each upright pole 10 and 12 and may be adjusted and made stationary to any desired height along the length of the upright poles 10 and 12. The springy tethers 20 and 22 are fixed in such a position so as to run from the eyelet 34 and 36 and across the rotable cam lever sleeve 14 and 16 with the result being that when the rotable cam lever sleeves 14 and 16 are rotated with the arc of the cam 14 and 16 moving away from the ball 24 the diameters of the rotable cam lever sleeves 14 and 16 are increased and tension is applied to the springy tethers 20 and 22.

The rotable cam lever sleeves 14 and 16 on the upright poles 10 and 12 may allow for retention of their rotation as follows, although not exclusively;

a. by holes 26 drilled through the sleeves 14 and 16 which, when aligned with holes 26 in the upright poles 10 and 12, allow insertion of a key 30 through both the pole 10 or 12 and the sleeve 14 and 16.

In another variation, the upright poles 10 and 12 may have multiple notches, slots, or eyelets attached at spaced intervals up and down the length of the upright poles 10 and 12 so as to provide means for raising and lowering the height of the ball 24 and to increase or decrease tension on the springy tethers 20 and 22.

Other variations are provided by methods to allow for an increase or decrease of the tension applied to the springy tethers 20 and 22.

5. The top stationary bar 18 attaches to the top of each upright pole 10 and 12. The player may, as an option, hold onto the top stationary bar 18 while using the device and thereby steady himself or herself in front of the ball 24.

6. The springy tethers 20 and 22 may be standard bungee type cords with hooks on both ends that may be purchased in any hardware store, or any suitable elastic or metal spring material.

7. By way of example and not limitation, the soccer ball 24 may be encased in a bag 28 made of any suitable material. For further example and not limitation, the ball 24 fits snugly into the bag 28 and the bag is fitted with a Velcro or standard type zipper to allow for easy insertion of the ball 24 into the bag 28. On opposite sides of the bag 28 are sewn an eyelet 32 for insertion of the hook on the end of the springy tether 20 and 22 or the material itself may be doubled back and sewn down so as to create an eyelet.

8. In another variation, eyelets may be directly attached to the ball 24 so as to allow for attachment of the springy tethers 20 and 22.

Once the device is assembled in the desired area, the device is utilized as follows: The player stands on either side of the device between the poles 10 and 12 and approximately one to two feet from the ball 24. The player then begins to kick the ball 24 with alternating feet each kick. The player may desire to hold onto the top stationary bar 18 to steady the player or until the player increases in ability enough to kick the ball 24 without holding onto the top stationary bar 18. This exercise is similar to exercise regimens conducted by players who are dribbling the ball 24 between their feet.

The tension on the springy tethers 20 and 22 can then be adjusted to increase or decrease the return speed of the ball 24 to suit the individual player's desire or level of ability. The height of the ball 24 may also be adjusted to the individual player's desire so that different muscles may be exercised as the legs must naturally be raised and lowered to different heights according to the height of the ball 24. The ball 24 may also be raised to a height sufficient to allow the player to strike the ball 24 with the knees such as when the player is practicing juggling the ball 24.

When striking the ball 24 with the feet, the player may choose any of the three methods currently taught to soccer players for actually placing the foot in contact with the ball 24.

These methods are as follows;

1. Striking the ball 24 with the inside of the foot: or,
2. Striking the ball 24 with the outside of the foot; or,
3. Striking the ball 24 on the laces of the foot and shoe.
4. The player may also strike the ball 24 with the tips of the toes on each foot.

Using the device in the above described manner provides the player with a training workout whereby the player obtains the benefits of increased speed of leg and foot movement, increased agility of leg, foot, and body movement, increased eye, foot, knee, and body coordination, and increased physical stamina. Because of the small area needed for the device during its use, it is an excellent device to be used indoors as well as out.

The invention not only allows but requires that the player move his body and limbs in the manners that correct performance of the sport requires. At the same time, the player is practicing movements of the entire body to improve speed and agility. This gives the player the benefit of increased fluidity of body movement and eye coordination. The invention also allows the player to use both feet in rapid succession, with the speed of the rapid succession adjustable to the individual player's needs and abilities.

The invention allows the player not only to practice dribbling with both feet, but also allows the player to practice juggling with both feet and both knees. This embodiment arises from the structural design of the invention whereby the ball 24 may be raised to different heights for different training regimens and by allowing the kicked ball 24 to travel horizontally as well as vertically. This feature also allows the device to be used by players of different height, to be adjusted to their particular height requirements.

The invention offers stabilization to the player, if desired. The player may simply grasp with one or both hands the top stationary bar 18 if the player feels the need for help to stay better centered with the ball 24 or if the player is off balance.

The invention also allows use by the player from either side of the device.

Changes may be made in the combinations, operations and arrangements of the various parts and elements described herein without departing from the spirit and scope of the invention as defined in the following claims.

I claim:

1. A captive ball apparatus for practice purposes comprising:

a left pole having a top and a bottom and a length there between;

a left rotable sleeve of predetermined length that is positioned around said left pole with a cam lever attached to said rotable sleeve and with an attachment for one end of at least one springy tether when the training apparatus is in an operating condition;

a right pole having a top and a bottom and a length there between that is positioned a predetermined distance from said left pole when the training apparatus is in an operating condition;

a right rotable sleeve of predetermined length that is positioned around said right pole with a cam lever attached to said rotable sleeve and with an attachment for one end of at least one springy tether when the training apparatus is in an operating condition;

means for independantly securing said left and right poles for supporting said poles in a generally vertical position such that each pole is independantly held in said generally vertical position when the apparatus is in an operating condition;

a ball suspended between said left and right rotable sleeves by at least one springy tether when the apparatus is in an operating condition; and, means provided to secure in place said left and right rotable sleeves to different predetermined heights along the lengths of said left and right poles.

2. The apparatus of claim 1 wherein all parts are comprised of any material of sufficient strength to withstand vibration, wear and tear, and provide sufficient tensile strength.

3. The apparatus of claim 2 wherein said left and right poles and said left and right rotable sleeves are comprised with a plurality of holes spaced evenly at predetermined distance on the vertical axis of said left and right poles and on the horizontal axis of said left and right rotable sleeves to allow for insertion of a key.

4. The apparatus of claim 3 further comprising a generally horizontal bar extending from the top of said left pole to the top of said right pole.

5. The apparatus of claim 4 wherein means is provided for holding said left and right poles in a generally vertical position by way of weighted bases.

6. The apparatus of claim 5 wherein means is provided for holding said left and right poles in a generally vertical position by way of any of the class of anchoring devices that are part of or pass through said weighted bases and into the ground.

7. A captive ball apparatus for practice purposes comprising:

a left pole having a top and a bottom and a length there between;

a left rotable sleeve of predetermined length that is positioned around said left pole with a cam lever attached to said rotable sleeve and with an attachment for one end of at least one springy tether when the training apparatus is in an operating condition;

a right pole having a top and a bottom and a length there between that is positioned a predetermined distance from said left pole when the training apparatus is in an operating condition;

a right rotable sleeve of predetermined length that is positioned around said right pole with a cam lever attached to said rotable sleeve and with an attachment for one end of at least one springy tether when the training apparatus is in an operating condition;

means for independantly securing said left and right poles for supporting said poles in a generally vertical position such that each pole is independantly held in said generally vertical position when the apparatus is in an operating condition;

a ball suspended between said left and right rotable sleeves by at least one springy tether when the apparatus is in an operating condition; and, means provided to secure in place said left and right rotable sleeves to different predetermined heights along the lengths of said left and right poles wherein said left and right poles and left and right rotable sleeves are comprised with a plurality of holes spaced evenly at predetermined distance on the vertical axis of said left and right poles and on the horizontal axis of said left and right rotable sleeves to allow for insertion of a key.

8. The apparatus of claim 7 wherein all parts are comprised of any material of sufficient strength to withstand vibration, wear and tear, and provide sufficient tensile strength.

9. The apparatus of claim 8 further comprising a generally horizontal bar extending from the top of said left pole to the top of said right pole.

10. The apparatus of claim 9 wherein means is provided for holding said left and right poles in a generally vertical position by way of weighted bases.

11. The apparatus of claim 10 wherein means is provided for holding said left and right poles in a generally vertical position by way of any of the class of anchoring devices that are part of or pass through said weighted bases and into the ground.

12. A captive ball apparatus for practice purposes comprising:

a left pole having a top and a bottom and a length there between;

a right pole having a top and a bottom and a length there between;

a rotatable sleeve positioned around at least one of said poles, said rotatable sleeve including an attachment for at least one tether when the training apparatus is in an operating condition, said rotatable sleeve increasing or decreasing tension on a tether when said rotatable sleeve is rotated;

a ball suspended between said poles by one or more tethers, wherein at least one tether is springy, and at least one tether is attached to said rotatable sleeve.

13. The captive ball apparatus of claim 12 further comprising a cam lever attached to said rotatable sleeve and with an attachment on said cam lever for at least one tether.

14. The captive ball apparatus of claim 12 further comprising means for securing said sleeve along the length of at least one of said poles.

15. The captive ball apparatus of claim 14 further comprising means for selectively securing said sleeve to at least one of said poles to prevent said sleeve from rotating on said pole when secured.

16. The captive ball apparatus of claim 15 wherein said means for securing said sleeve along the length of at least one of said poles and said means for selectively securing said sleeve to at least one of said poles to prevent said sleeve from rotating on said pole when secured comprises: a plurality of holes in said pole and corresponding holes in said sleeve for the insertion of a key.

17. The captive ball apparatus of claim 12 further comprising a plurality of holes in at least one of said poles and on said rotatable sleeve to allow for insertion of a key.

* * * * *